US012612143B2

(12) United States Patent
Haas

(10) Patent No.: US 12,612,143 B2
(45) Date of Patent: Apr. 28, 2026

(54) PADDLE

(71) Applicant: Joel C. Haas, Jupiter, FL (US)

(72) Inventor: Joel C. Haas, Jupiter, FL (US)

(73) Assignee: Joel C. Haas, Jupiter, FL (US)

( * ) Notice: Subject to any disclaimer, the term of this patent is extended or adjusted under 35 U.S.C. 154(b) by 608 days.

(21) Appl. No.: 18/012,783

(22) PCT Filed: Jun. 25, 2021

(86) PCT No.: PCT/US2021/039064
§ 371 (c)(1),
(2) Date: Dec. 23, 2022

(87) PCT Pub. No.: WO2021/263089
PCT Pub. Date: Dec. 30, 2021

(65) Prior Publication Data

US 2023/0264796 A1 Aug. 24, 2023

Related U.S. Application Data

(60) Provisional application No. 63/043,968, filed on Jun. 25, 2020.

(51) Int. Cl.
*B63H 16/04* (2006.01)

(52) U.S. Cl.
CPC ..... *B63H 16/04* (2013.01)

(58) Field of Classification Search
CPC ..... B63H 16/00; B63H 16/04
USPC ..... 440/101
See application file for complete search history.

(56) References Cited

U.S. PATENT DOCUMENTS

| | | | | |
|---|---|---|---|---|
| 3,800,734 | A | 4/1974 | Whang | |
| 3,934,533 | A | 1/1976 | Wainwright | |
| 6,210,244 | B1 | 4/2001 | Nordby | |
| 7,488,228 | B2 | 2/2009 | Scott | |
| 9,028,287 | B2 * | 5/2015 | Doyle | B63H 16/04 440/101 |
| 2018/0141629 | A1 | 5/2018 | Taylor | |
| 2019/0168855 | A1 | 6/2019 | Sharp et al. | |

FOREIGN PATENT DOCUMENTS

| | | | |
|---|---|---|---|
| RU | 2056327 | C1 | 3/1996 |
| RU | 2057685 | C1 | 4/1996 |
| WO | 2018029451 | A1 | 2/2018 |

* cited by examiner

*Primary Examiner* — Lars A Olson
(74) *Attorney, Agent, or Firm* — The Webb Law Firm

(57) ABSTRACT

A paddle blade including a plurality of blades that allows fluid flow in between and along the plurality of blades. Each of the plurality of blades may have an airfoil shape and may be positioned parallel to each other. The plurality of blades may include a central diverter blade including two symmetrical, concave lateral faces. The concave lateral faces are configured to redirect, along arcuate paths, fluid flow from a direction approximately perpendicular to a front face of the paddle blade toward lateral sides of the paddle blade. The plurality of blades also includes a first and a second pair of blades positioned on opposite lateral sides of the central diverter blade, each arranged to at least partially overlap either one of the concave lateral faces of the central diverter blade or an adjacent blade of the first pair of blades respectively.

10 Claims, 4 Drawing Sheets

PADDLE

CROSS REFERENCE TO RELATED APPLICATIONS

This application is the United States national phase of International Application No. PCT/US2021/039064 filed Jun. 25, 2021, and claims priority to United States Provisional Patent Application No. 63/043,968, including without limitation Appendix A thereto, filed on Jun. 25, 2020, the disclosures of which, including without limitation Appendix A thereto, are hereby incorporated by reference in their entireties.

BACKGROUND

Field of the Invention

This disclosure relates generally to paddles.

Technical Considerations

When moving a paddle against a fluid, e.g., water, there is a need to increase the amount of drag of the paddle being pulled through water to generate an opposite force, such as to propel a watercraft. Higher drag can increase propulsion for a watercraft. However, many shapes of paddles that increase drag also generate inefficient fluid disturbance and increase vortex shedding, which may create counteracting fluid flow on, around, and/or near the paddle. Such paddles often frustrate the propulsion of a watercraft.

There is a need in the art for an improved paddle that increases drag without generating additional vortex shedding and fluid disturbance.

SUMMARY

Provided is a paddle having a paddle blade including a plurality of blades that allows fluid flow in between and along the plurality of blades through the paddle blade. Each of the blades may have an airfoil shape. Each of the blades may also be positioned parallel to at least one other adjacent blade. The plurality of blades may be configured to have an overlap in a cascading configuration such that the fluid flow initially directed into the front face of the paddle blade cannot pass through the front face of the paddle blade along an uninterrupted linear path but is turned to an extent.

A paddle with a cascading airfoil design produces more drag for the same paddle width and fluid velocity as existing pure drag designs for paddles that comprise a flat plate normal to the fluid flow.

The plurality of blades may also include a central diverter blade including two symmetrical, concave lateral faces sharing a leading edge. The concave lateral faces are configured to redirect, along arcuate paths, fluid flow from a direction approximately perpendicular to a front face of the paddle blade toward lateral sides of the paddle blade. The plurality of blades also includes a first pair of blades positioned on opposite lateral sides of the central diverter blade, each arranged to at least partially overlap one of the concave lateral faces of the central diverter blade. The plurality of blades includes a second pair of blades positioned on opposite lateral sides of the first pair of blades, each arranged to at least partially overlap an adjacent blade of the first pair of blades.

According to non-limiting embodiments or aspects, provided is a paddle blade including a plurality of blades. The paddle includes a central diverter blade shaped as an approximately triangular prism. The central diverter blade includes two symmetrical, concave lateral faces sharing a leading edge. The concave lateral faces are configured to redirect, along arcuate paths, fluid flow from a direction approximately perpendicular to a front face of the paddle blade toward lateral sides of the paddle blade. The plurality of blades also includes a first pair of blades positioned on opposite lateral sides of the central diverter blade. Each blade of the first pair of blades is arranged to at least partially overlap one of the concave lateral faces of the central diverter blade. The first pair of blades each have an airfoil shape configured to further redirect the fluid flow along arcuate paths and increase a drag of the paddle blade through fluid. The plurality of blades also includes a second pair of blades positioned on opposite lateral sides of the first pair of blades. Each blade of the second pair of blades is arranged to at least partially overlap an adjacent blade of the first pair of blades. Each of the blades may be parallel to at least one other adjacent parallel blade. The second pair of blades each has an airfoil shape configured to further redirect the fluid flow along arcuate paths and increase the drag of the paddle blade through fluid.

In further non-limiting embodiments or aspects, the plurality of blades may be configured to have an overlap such that the fluid flow initially directed into the front face of the paddle blade cannot pass through the front face of the paddle blade along an uninterrupted linear path. The plurality of blades may also be configured to have airfoil shapes. Each of the plurality of blades may also be configured to be parallel to at least one other adjacent blade of the plurality of blades.

In further non-limiting embodiments or aspects, the paddle may further include a shaft. The paddle blade may attach to a throat that is centrally attached to a first end of the shaft. The paddle may include a handle attached to a second end of the shaft opposite the first end. The paddle may also include a second paddle blade including a second plurality of blades attached to a second end of the shaft opposite the first end. The second paddle blade may have a same arrangement as the paddle blade attached to the first end.

In further non-limiting embodiments or aspects, each respective blade of the first pair of blades and the second pair of blades may have a rounded leading edge on a side of the respective blade more proximal to a central axis of the paddle blade. Each respective blade of the first pair of blades and the second pair of blades may have an under-cambered airfoil shape.

According to non-limiting embodiments or aspects, provided is a method of propelling a watercraft using the paddle described in any of the above embodiments. The method includes submerging the paddle blade in water surrounding the watercraft. The method also includes pulling, from a fixed point within the watercraft, the paddle through the water in a direction opposite a direction of travel of the watercraft.

Other non-limiting embodiments or aspects will be set forth in the following numbered clauses:

Clause 1: A paddle comprising: a paddle blade comprising a plurality of blades comprising: a central diverter blade shaped as an approximately triangular prism, the central diverter blade comprising two symmetrical, concave lateral faces sharing a leading edge, the concave lateral faces configured to redirect, along arcuate paths, fluid flow from a direction approximately perpendicular to a front face of the paddle blade toward lateral sides of the paddle blade; a first pair of blades positioned on opposite lateral sides of the central diverter blade, each blade of the first pair of blades arranged to at least partially overlap one of the concave lateral faces of the central diverter blade, the first pair of blades each having an airfoil shape configured to further redirect the fluid flow along arcuate paths and increase a drag of the paddle blade through fluid; and a second pair of blades positioned on opposite lateral sides of the first pair of blades, each blade of the second pair of blades arranged to at least partially overlap an adjacent blade of the first pair of blades, the second pair of blades each having an airfoil shape configured to further redirect the fluid flow along arcuate paths and increase the drag of the paddle blade through fluid.

Clause 2: The paddle of clause 1, wherein the plurality of blades are configured to overlap such that the fluid flow initially directed into the front face of the paddle blade cannot pass through the front face of the paddle blade along an uninterrupted linear path.

Clause 3: The paddle of clause 1 or 2, further comprising a shaft, wherein the paddle blade tapers to a throat that is centrally attached to a first end of the shaft.

Clause 4: The paddle of any of clauses 1-3, further comprising a handle attached to a second end of the shaft opposite the first end.

Clause 5: The paddle of any of clauses 1-4, further comprising a second paddle blade comprising a second plurality of blades attached to a second end of the shaft opposite the first end, the second paddle blade having a same arrangement as the paddle blade attached to the first end.

Clause 6: The paddle of any of clauses 1-5, wherein each respective blade of the first pair of blades and the second pair of blades has a rounded leading edge on a side of the respective blade more proximal to a central axis of the paddle blade.

Clause 7: The paddle of any of clauses 1-6, wherein each respective blade of the first pair of blades and the second pair of blades has an under-cambered airfoil shape.

Clause 8: A method of propelling a watercraft using the paddle of clause 1, comprising: submerging the paddle blade in water surrounding the watercraft; and pulling, from a fixed point within the watercraft, the paddle through the water in a direction opposite a direction of travel of the watercraft.

These and other features and characteristics of the present disclosure, as well as the methods of operation and functions of the related elements of structures, and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

BRIEF DESCRIPTION OF THE DRAWINGS

Additional advantages and details are explained in greater detail below with reference to the non-limiting, exemplary embodiments that are illustrated in the accompanying schematic figures, in which.

DESCRIPTION OF THE PREFERRED EMBODIMENTS

Figure 1:
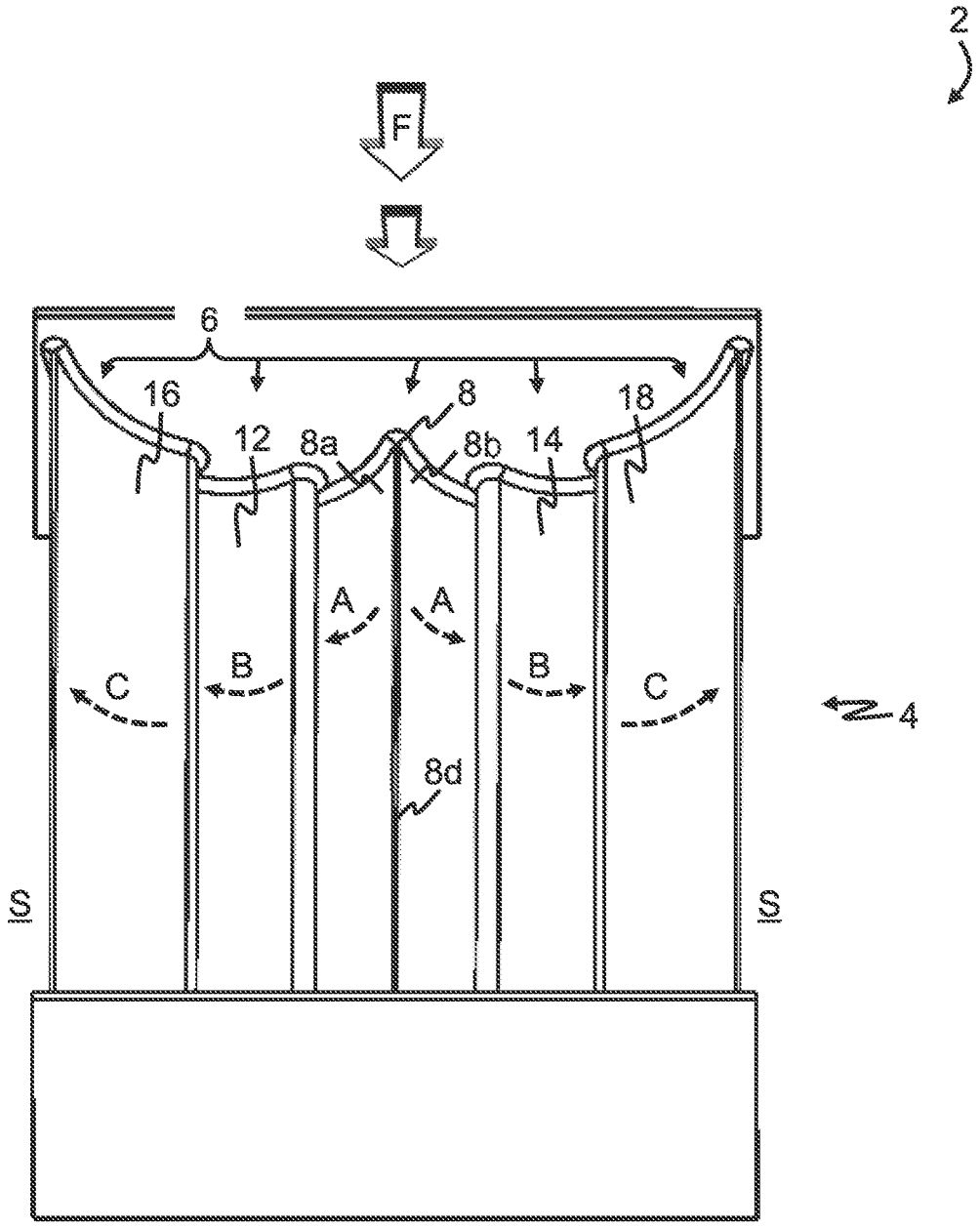
FIG. 1 is a depiction of a paddle from a lower front view, according to non-limiting embodiments or aspects.

For purposes of the description hereinafter, the terms "end," "upper," "lower," "right," "left," "vertical," "horizontal," "top," "bottom," "lateral," "longitudinal," and derivatives thereof shall relate to the embodiments as they are oriented in the drawing figures. However, it is to be understood that the embodiments may assume various alternative variations and step sequences, except where expressly specified to the contrary. It is also to be understood that the specific devices and processes illustrated in the attached drawings, and described in the following specification, are simply exemplary embodiments or aspects of the invention. Hence, specific dimensions and other physical characteristics related to the embodiments or aspects disclosed herein are not to be considered as limiting.

No aspect, component, element, structure, act, step, function, instruction, and/or the like used herein should be construed as critical or essential unless explicitly described as such. Also, as used herein, the articles "a" and "an" are intended to include one or more items and may be used interchangeably with "one or more" and "at least one." Furthermore, as used herein, the term "set" is intended to include one or more items (e.g., related items, unrelated items, a combination of related and unrelated items, and/or the like) and may be used interchangeably with "one or more" or "at least one." Where only one item is intended, the term "one" or similar language is used. Also, as used herein, the terms "has," "have," "having," or the like are intended to be open-ended terms. Further, the phrase "based on" is intended to mean "based at least partially on" unless explicitly stated otherwise.

Non-limiting embodiments or aspects of the described paddle provide the benefit of increasing drag of the paddle through fluid, e.g., water, while reducing vortex shedding, particularly to zero. The described design produces the surprising and non-obvious result of up to zero vortex shedding, while still providing excellent drag of the paddle through water. The paddle provides increased efficiencies in generating drag through the water given the same paddle width and velocity of water entering the face of the paddle blade.

Non-limiting embodiments or aspects of the described paddle provide the benefit of increasing drag of the paddle through fluid, e.g., water, because the gaps between the blades and the airfoil shape of the blades allows the fluid flow to remain attached to the blades a longer distance along the length of each blade between the leading edge of the blade to the trailing edge of the blade, thereby delaying separation of the flow from the blade and producing more drag.

The overlapping, cascading airfoil shapes of the blades described in certain of the non-limiting embodiments of the described paddle also provide the unique ability to turn the direction of the flow of the fluid such that at least a portion of the flow will be in the same direction as the paddle movement. Existing prior art paddles slow the flow but do not reverse the flow of the fluid. The use of cascading blades with airfoil shapes described in the non-limiting embodiments of the described paddle provide the ability to prevent flow separation as the high pressure flow field from the upstream blade with an airfoil shape is directed to the lower pressure flow field of each downstream blade with an airfoil shape, thereby allowing reverse fluid flow in the direction of paddle movement. The geometry of the overlapping, cascading airfoil shapes of the blades can be adjusted to keep the fluid flow attached to at least one of the plurality of blades from the leading edge to the trailing edge of the blade.

Figure 2:
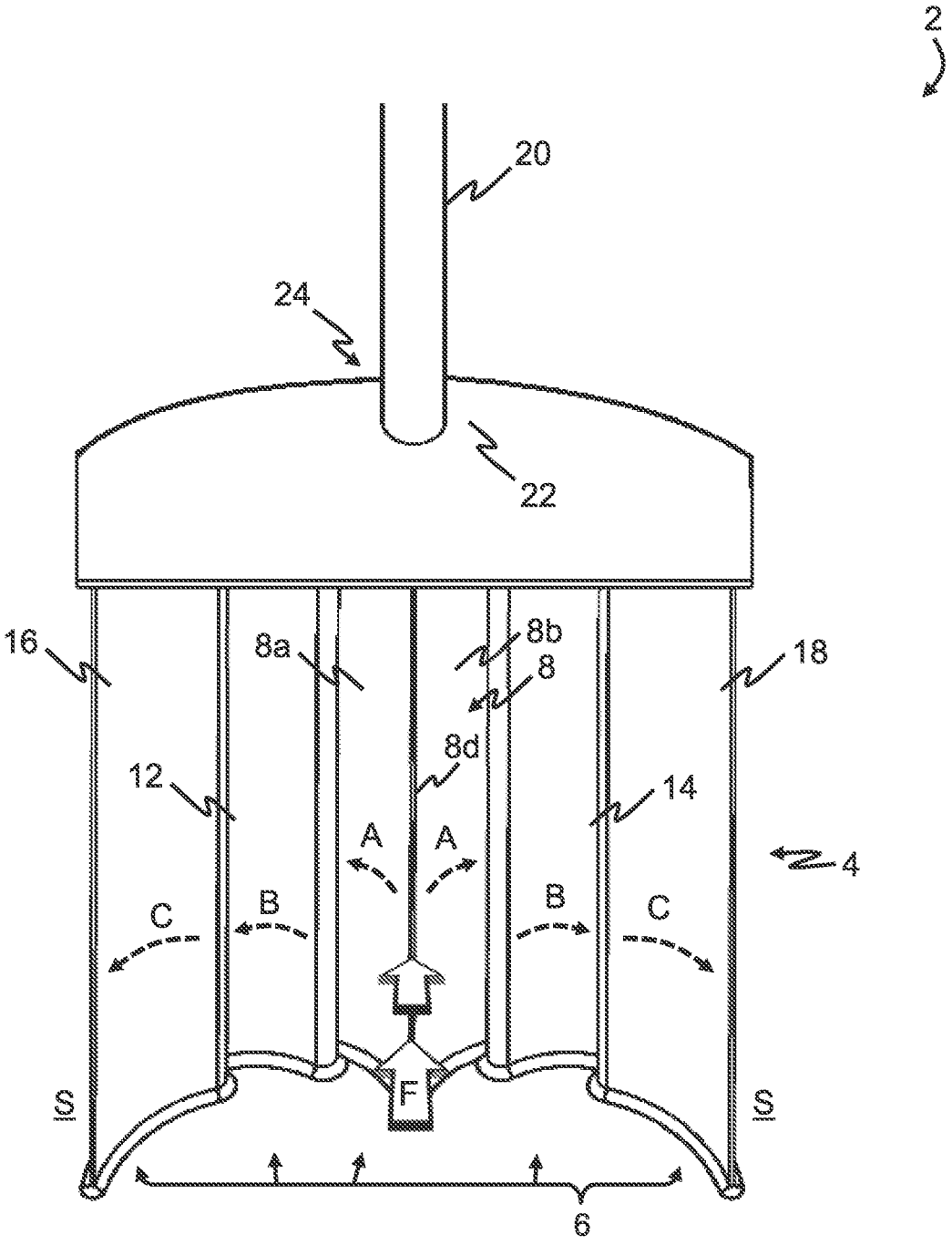
FIG. 2 is a depiction of a paddle having a shaft from an upper front view, according to non-limiting embodiments or aspects.

Referring to FIGS. 1 and 2, depicted is a paddle 2 according to non-limiting embodiments or aspects. The paddle 2 includes a paddle blade 4 that includes a plurality of blades 6 each of which may be configured to be parallel to an adjacent blade. The plurality of blades 6 may be arranged lengthwise (e.g., longitudinally) along the face of the paddle blade 4, perpendicular to a surface plane of fluid (e.g., surface of water) in which the paddle 2 is to be submerged. The paddle blade 4 may also include a central diverter blade 8 shaped as an approximately triangular prism. The central diverter blade 8 may include a concave or a convex rear face (not shown, see Appendix A) and includes two symmetrical, concave lateral faces 8*a*, 8*b* sharing a leading edge 8*d*. In some non-limiting embodiments, the diverter blade 8 may include two of three sides of a triangular prism, such as having only the two concave lateral faces 8*a*, 8*b*. The concave lateral faces 8*a*, 8*b* are configured to redirect, along arcuate paths A, fluid flow (e.g., water flow) from an initial direction F approximately perpendicular to a front face of the paddle blade 4 toward lateral sides S of the paddle blade 4. It will be appreciated that the paddle 2 is configured to provide drag where at least one component of a vector of fluid flow toward the face of the paddle blade 4 is perpendicular to the face of the paddle blade 4.

With further reference to FIGS. 1 and 2, the paddle blade 4 further includes a first pair of blades 12, 14 positioned on opposite lateral sides of the central diverter blade 8. Each blade of the first pair of blades 12, 14 is arranged to at least partially overlap one of the concave lateral faces 8*a*, 8*b* of the central diverter blade 8. For example, a first blade 12 of the first pair of blades 12, 14 may overlap, from a front perspective, a first concave lateral face 8*a* of the central diverter blade 8. A second blade 14 of the first pair of blades 12, 14 may overlap, from a front perspective, a second concave lateral side 8*b* of the central diverter blade 8. Each of the first pair of blades 12, 14 have an airfoil shape configured to further redirect the fluid flow along arcuate paths B and increase a drag of the paddle blade 4 through fluid.

With further reference to FIGS. 1 and 2, the paddle blade 4 further includes a second pair of blades 16, 18 positioned on opposite lateral sides of the first pair of blades 12, 14. Each blade of the second pair of blades 16, 18 is arranged to at least partially overlap an adjacent blade of the first pair of blades 12, 14. For example, a first blade 16 of the second pair of blades 16, 18 may overlap, from a front perspective, a first blade 12 of the first pair of blades 12, 14. A second blade 18 of the second pair of blades 16, 18 may overlap, from a front perspective, a second blade 14 of the first pair of blades 12, 14. Each of the second pair of blades 16, 18 have an airfoil shape configured to further redirect the fluid flow along arcuate paths C and increase a drag of the paddle blade 4 through fluid.

With further reference to FIGS. 1 and 2, the plurality of blades 6 may be configured to overlap such that the fluid flow initially directed F into the front face of the paddle blade 4 cannot pass through the front face of the paddle blade 4 along an uninterrupted linear path. For example, when viewed from a front perspective, there may be no perceivable gap between blades of the plurality of blades 6.

With further reference to FIG. 2, the paddle 2 may further include a shaft 20. The paddle blade 4 may taper to a throat 22 that is centrally attached to a first end 24 of the shaft 20.

Figure 3A:
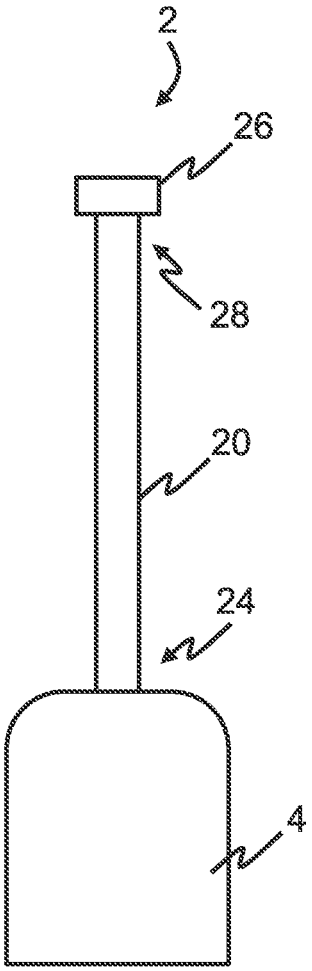
FIG. 3A is a depiction of a paddle having a shaft and a handle from a front view, according to non-limiting embodiments or aspects.
Figure 3B:
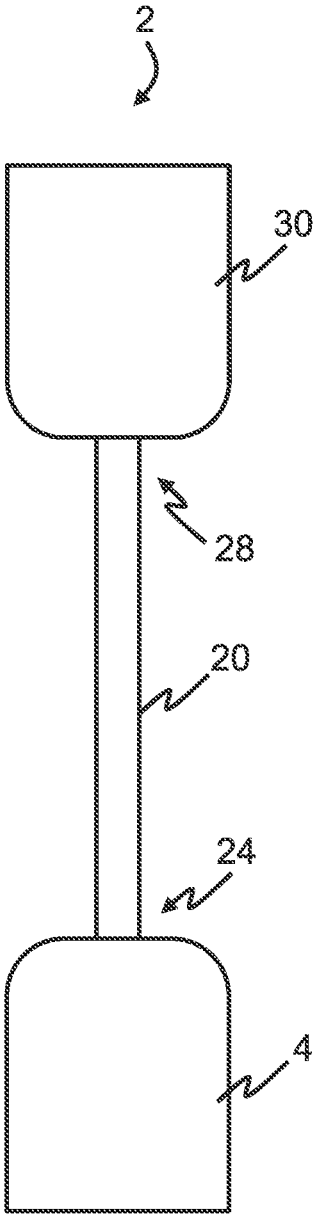
FIG. 3B is a depiction of a paddle having a shaft and a second paddle blade from a front view, according to non-limiting embodiments or aspects.

Referring to FIGS. 3A and 3B, depicted are paddles 2 according to non-limiting embodiments or aspects. As shown in FIG. 3A, the shaft 20 may further include a handle 26 attached to a second end 28 of the shaft 20 opposite the first end 24. A user of the paddle 2 may grip the handle 26 in one hand and the shaft 20 in another hand in order to manipulate the movement of the paddle 2, e.g., the paddle blade 4 through water. As shown in FIG. 3B, the paddle 2 may further include a second paddle blade 30 having a second plurality of blades attached to the second end 28 of the shaft 20 opposite the first end 24. The second paddle blade 30 may have a same arrangement of blades as the paddle blade 4 attached to the first end 24. The second paddle blade 30 may be configured in a rotated position relative to the central axis to be at an angle offset from the paddle blade 4 on the first end 24.

Figure 4:
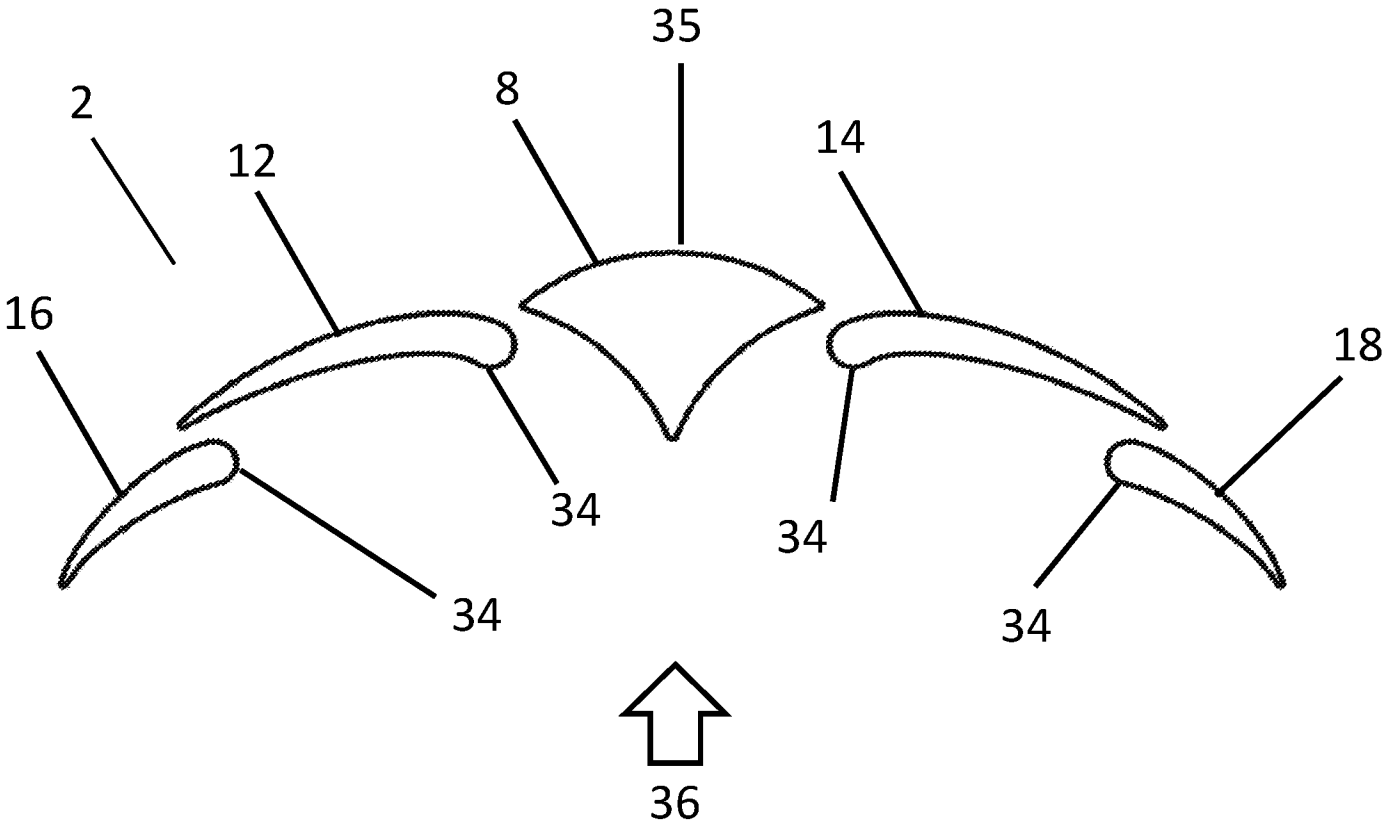
FIG. 4 is a depiction of a cross-section of a paddle according to non-limiting embodiments or aspects; and Appendix A, filed as part of U.S. Provisional Patent Application No. 63/043,968, provides further non-limiting embodiments or aspects of the design and utility of the paddle described herein.

Referring to FIG. 4, depicted is a cross-section of a paddle 2 according to non-limiting embodiments or aspects. Each blade of the second pair of blades 16, 18 is arranged to at least partially overlap an adjacent blade of the first pair of blades 12, 14. For example, a first blade 16 of the second pair of blades 16, 18 may overlap, from a front perspective, a first blade 12 of the first pair of blades 12, 14. A second blade 18 of the second pair of blades 16, 18 may overlap, from a front perspective, a second blade 14 of the first pair of blades 12, 14. The depicted paddle blade in FIG. 4 may be configured to include a third pair of blades (not shown) positioned on opposite lateral sides of the second pair of blades 16, 18. Each of the third pair of blades could have an airfoil shape like each of the first and second pair of blades configured to further redirect the fluid flow along arcuate paths and increase a drag of the paddle blade through fluid. It will be appreciated that additional pairs of blades may be employed in similar arrangements following the same relationships as the second pair of blades 16, 18 relative to the first pair of blades 12, 14. Fewer than two pairs of blades may also be employed.

With further reference to FIG. 4, each respective blade of the first pair of blades 12, 14, and the second pair of blades 16, 18 may have a rounded leading edge 34 on a side of the respective blade more proximal to a middle axis 35 of the paddle 2, e.g., the paddle blade. Each respective blade of the first pair of blades 12, 14, and the second pair of blades 16, 18, may have an under-cambered airfoil shape. The airfoil shape of each blade may differ to promote increased drag, improve flow of fluid 36 over the blade, and/or decrease vortex shedding.

With further reference to the foregoing figures, the paddle 2 may be used to propel a watercraft, such as by submerging the paddle blade 4 in water surrounding the watercraft and pulling, from a fixed point within the watercraft, the paddle through the water in a direction opposite a direction of travel of the watercraft.

Provided with U.S. Provisional Patent Application No. 63/043,968 to which this application claims priority is Appendix A, depicting additional views and testing of the described paddle. As shown on the last page of Appendix A, one potential paddle product design concept incorporating the paddle design described herein comprises separate airfoil shapes assembled to the base and the tip of the paddle blade wherein the base is assembled to the shaft of the paddle.

The components of the paddle may be plastic injected molded in non-limiting embodiments, although one of ordinary skill in the art would appreciate that other materials and processes may be used to construct the components of the paddle.

Although embodiments have been described in detail for the purpose of illustration, it is to be understood that such detail is solely for that purpose and that the disclosure is not limited to the disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

The invention claimed is:

1. A paddle comprising:

a paddle blade comprising a plurality of blades comprising:

a central diverter blade shaped as an approximately triangular prism, the central diverter blade comprising two symmetrical, concave lateral faces sharing a leading edge, the concave lateral faces configured to redirect, along arcuate paths, fluid flow from a direction approximately perpendicular to a front face of the paddle blade toward lateral sides of the paddle blade;

a first pair of blades positioned on opposite lateral sides of the central diverter blade, each blade of the first pair of blades arranged to at least partially overlap one of the concave lateral faces of the central diverter blade, the first pair of blades each having an airfoil shape configured to further redirect the fluid flow along arcuate paths and increase a drag of the paddle blade through fluid; and a second pair of blades positioned on opposite lateral sides of the first pair of blades, each blade of the second pair of blades arranged to at least partially overlap an adjacent blade of the first pair of blades, the second pair of blades each having an airfoil shape configured to further redirect the fluid flow along arcuate paths and increase the drag of the paddle blade through fluid.

2. The paddle of claim 1, wherein the plurality of blades are configured to overlap such that the fluid flow initially directed into the front face of the paddle blade cannot pass through the front face of the paddle blade along an uninterrupted linear path.

3. The paddle of claim 1, further comprising a shaft, wherein the paddle blade tapers to a throat that is centrally attached to a first end of the shaft.

4. The paddle of claim 3, further comprising a handle attached to a second end of the shaft opposite the first end.

5. The paddle of claim 3, further comprising a second paddle blade comprising a second plurality of blades attached to a second end of the shaft opposite the first end, the second paddle blade having a same arrangement as the paddle blade attached to the first end.

6. The paddle of claim 1, wherein each respective blade of the first pair of blades and the second pair of blades has a rounded leading edge on a side of the respective blade more proximal to a central axis of the paddle blade.

7. The paddle of claim 2, wherein each respective blade of the first pair of blades and the second pair of blades has an under-cambered airfoil shape.

8. The paddle of claim 1, wherein each blade of said plurality of blades is positioned parallel to at least one other adjacent blade of said plurality of blades.

9. A paddle comprising:

a paddle blade comprising a plurality of blades and a central diverter blade wherein each of said plurality of blades has an airfoil shape with a leading edge and a trailing edge, and is positioned parallel to at least one other adjacent blade of said plurality of blades such that a gap exists between adjacent blades, and wherein the plurality of blades are configured to overlap in a cascading configuration and the central diverter blade is configured such that fluid flow initially directed perpendicular to a front face of the paddle blade is turned by the central diverter blade to flow along the airfoil shape of at least one of the plurality of the blades toward a side of the paddle board such that separation of the flow from the leading edge to the trailing edge of said one of the plurality of the blades is prevented.

10. A method of propelling a watercraft using the paddle of claim 1, comprising:

submerging the paddle blade in water surrounding the watercraft; and pulling, from a fixed point within the watercraft, the paddle through the water in a direction opposite a direction of travel of the watercraft.

* * * * *